US007313929B2

(12) United States Patent
Lazor

(10) Patent No.: US 7,313,929 B2
(45) Date of Patent: Jan. 1, 2008

(54) WEARABLE RECORD TRACKING DEVICE AND METHOD OF USING

(75) Inventor: Susan Lazor, Brooklyn, NY (US)

(73) Assignee: Unique Mums, LLC, Avon, CT (US)

( * ) Notice: Subject to any disclaimer, the term of this patent is extended or adjusted under 35 U.S.C. 154(b) by 0 days.

(21) Appl. No.: 11/047,055

(22) Filed: Jan. 31, 2005

(65) Prior Publication Data

US 2005/0166636 A1 Aug. 4, 2005

Related U.S. Application Data

(60) Provisional application No. 60/541,569, filed on Feb. 4, 2004.

(51) Int. Cl.
*A44C 5/00* (2006.01)

(52) U.S. Cl. ..... 63/3; 235/1 R; 235/1 B; 116/278; 116/307; 368/224

(58) Field of Classification Search ..... 63/3, 63/5.1, 5.2, 6, 11, 41, 38, 21–23; 368/224, 368/225, 327; 116/278, 307; 434/246, 245; 235/124; D99/26
See application file for complete search history.

(56) References Cited

U.S. PATENT DOCUMENTS

D45,820 S * 5/1914 Sandahl ..... D11/11
3,094,754 A * 6/1963 Wayne ..... 24/116 R
3,323,324 A * 6/1967 Bohlinger et al. ..... 63/3.2
D415,976 S * 11/1999 Be ..... D11/4
6,179,621 B1 * 1/2001 Vaccari ..... 434/246
6,561,415 B2 * 5/2003 Grant ..... 235/61 R
6,747,917 B2 * 6/2004 Jennings et al. ..... 368/10
D505,353 S * 5/2005 Del Valle ..... D11/3

FOREIGN PATENT DOCUMENTS

EP 313070 A2 * 4/1989

* cited by examiner

*Primary Examiner*—Jack W. Lavinder
(74) *Attorney, Agent, or Firm*—Howard C. Miskin, Esq.; Gloria Tsui-Yip, Esq.

(57) ABSTRACT

A user wearable device for tracking or reminding the user of time and/or numerical records. In the preferred embodiment, the device takes the form of an attractive bracelet. The bracelet is made of two sets of beads strung together to form the bracelet and at least one charm for removable placement between the beads. The first set of beads has numbers marked thereon while the second set of beads does not have any markings. The two sets of beads are placed in a predetermined alternate fashion along the bracelet such that the at least one charm can be placed between certain beads to note the time and/or numerical record. In the preferred embodiment, each of the twelve sequentially numerically marked beads is separated by a predetermined number of unmarked beads, such as 4, such that each unmarked beads represents a fifteen (15) minute interval between the hours.

23 Claims, 5 Drawing Sheets

WEARABLE RECORD TRACKING DEVICE AND METHOD OF USING

This application claims the benefit of U.S. Provisional Application No. 60/541,569, filed Feb. 4, 2004.

FIELD OF THE INVENTION

The invention relates to an attractive record tracking device that is wearable by a user and a method of using such a device. In particular, the wearable device takes the form of a bracelet that tracks or reminds the user of time or numerical records.

BACKGROUND OF THE INVENTION

It is very common for people to keep track of and be reminded of time or numerical records throughout the day, days or week. For example, the last time a baby was fed (whether by breast or bottle) or the next time feeding is due, the number of wet/dry diapers in a day, the number of glasses of water drank in a day, the last time medication was taken or given or the next time medication is due, the time of an appointment, the number of cycles/laps completed during an exercise routine, etc.

The most basic record tracking device utilizes a writing instrument and a medium for recording the written notation, such as paper, self-adhesive notes, etc. Oftentimes, when a user needs to record a numerical record or note a time, either the writing instrument or the medium for recording the written notation, or both, is not readily available. Further, the writing instrument and medium for recording the written notation are often misplaced or lost when needed, such that a user cannot readily make the appropriate recordation.

Other prior art electronic gadgets are also available to remind a person of different time and for numerical recording. However, a user must first learn to manipulate, input and use and carry such electronic gadgets for effective recordation. Similarly, electronic gadgets are also often misplaced or lost when needed and prevent a user from readily making the appropriate recordation.

U.S. Pat. No. D415,976 entitled "Reminder Bracelet" discloses a bangle with numbers 1 through 8 marked thereon with an attachment for sliding over each number to note numerical records. Although this device is also wearable by a user and minimizes the likelihood of losing or misplacing the device, it cannot be used to track time and is not aesthetically pleasing as the numbers are not discreetly displayed.

U.S. Pat. No. 6,561,415 entitled "Calorie Management System" discloses a bracelet having a plurality of beads frictionally strung together for counting the number of calories consumed a day. After every five counting beads, with each representing a value of 100 calories, is a summing bead, which represent the 500 calories of the five counting beads. A freespace is provided along the bracelet such that a user slides the appropriate number of beads to one side of the bracelet to record the number of calories consumed. At the end of the day, the user would have to count the total number of beads to determine the number of calories consumed during the day. Although this device is also wearable by a user, it merely provides a counting device and fails to provide instantaneous information on the time and/or other numerical records.

For a new mother, it is important for her to record the time her baby was last fed or when the next feeding is due. This is especially important for a new mother who breastfeeds, as she faces many challenges: (1) to perfect the proper breastfeeding technique to avoid discomfort and ensure the baby is suckling well; (2) maintain an even milk supply and avoid breast engorgement by feeding equally from both breasts; (3) ensure the baby gets enough milk to thrive; (4) learn to differentiate between the baby's cry as a result of hunger or for other reasons. As new mothers are often overwhelmed with the new experience of caring and feeding a baby and suffer from lack of sleep, it is difficult to keep track of such information in a state of extreme fatigue.

Canadian Patent No. 2177291 discloses a device that reminds a new mother which breast she last fed her baby from. This device does not track time nor numerical records, but merely has a pivotable indicator that points to either the left or right breasts her baby last fed from. The device is designed to be attached to the mother's bra and is hidden from sight most of the time.

Some websites, such as www.thenewparentsguide.com, offer nursing logs for a nursing mother to keep track of the nursing pattern. This is not a practical method unless the mother has ready access to the computer. Although the nursing log may be printed for written notation, it suffers from the same disadvantages of losing or misplacing either the printout and/or the writing instrument when needed.

Therefore, there is a need for a device that is wearable, attractive, simple to use and visually tracks or reminds the user of time or numerical records.

SUMMARY OF THE INVENTION

The present invention is an aesthetically pleasing looking bracelet to be worn on a user's wrist that tracks or reminds the user of time or numerical records.

The bracelet of the present invention comprises two sets of beads strung together to form the bracelet and at least one charm for removable placement between the beads, acting as the marker/indicator. The first set of beads has numbers marked thereon while the second set of beads does not have any markings. The two sets of beads are placed in a predetermined alternate fashion along the bracelet such that the at least one charm can be placed between certain beads to note the time and/or numerical record. In the preferred embodiment, each sequentially numerically marked bead is separated by four unmarked beads such that each unmarked bead represents a fifteen (15) minute interval.

The bracelet of the present invention allows a user to discreetly note time or numerical records without having to worry about losing or misplacing the records. Further, the bracelet of the present invention is simple to use, can be easily removed and looks aesthetically pleasing.

The bracelet of the present invention particularly meets the need of a nursing mother. Not only does the bracelet note time or numerical records, its placement on the appropriate wrist also notes the last breast feeding cycle and indicates to the mother which breast her baby last fed from. For example, when the baby cries, an inexperienced mother may not know if her baby is hungry or not, or she may just be so tired that she cannot remember when the baby was last fed (which is especially true during the night when the mother may be only half awake), but a quick look at the bracelet of the present invention will help her determine if another feeding is due.

DETAILED DESCRIPTION OF THE PREFERRED EMBODIMENTS

Figure 1:
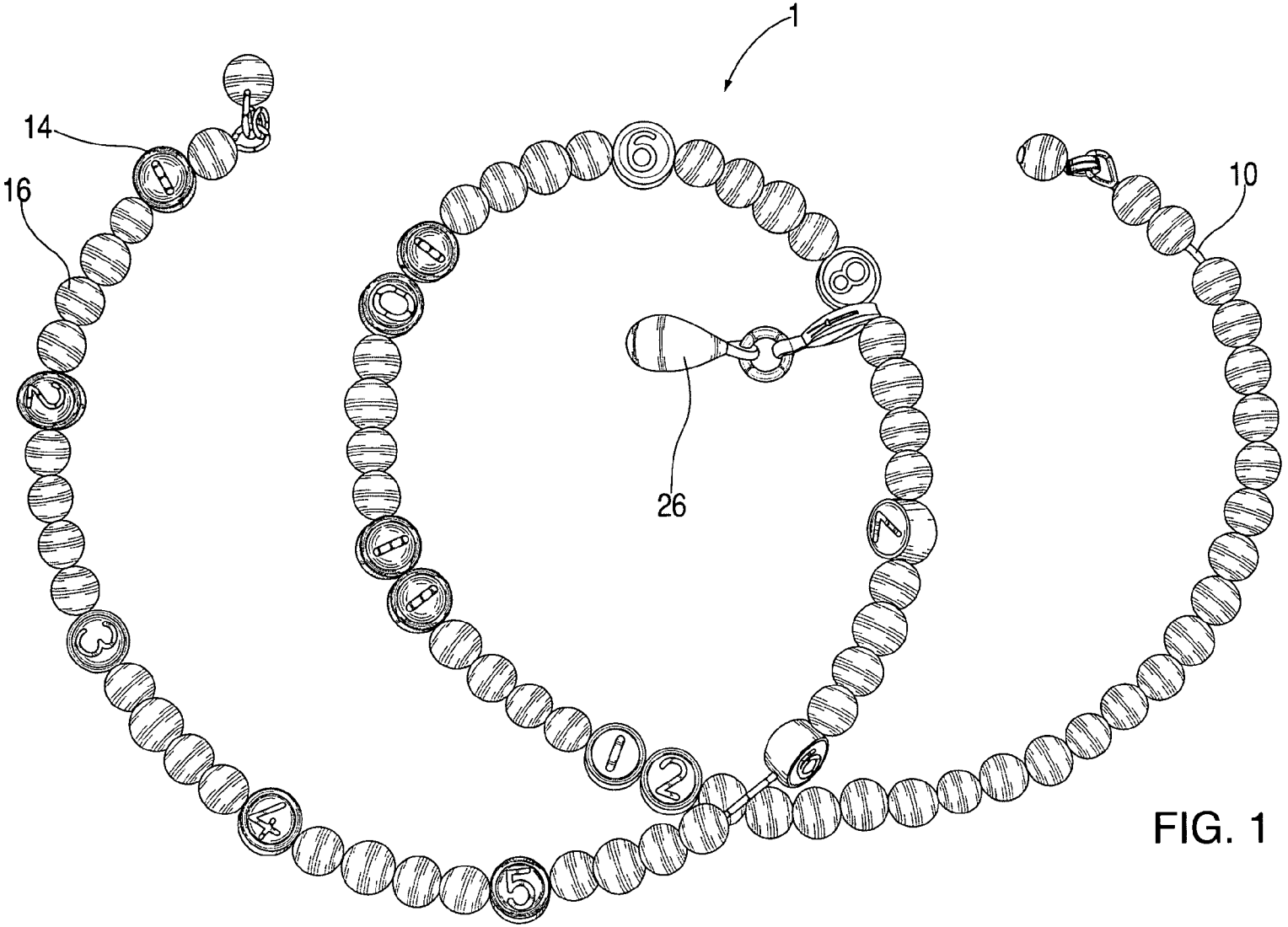
FIG. 1 is the bracelet of the present invention in a slightly extended position.

With reference to the drawing wherein the same reference number illustrates the same element throughout, FIG. 1 shows a bracelet 1 of the present invention. Bracelet 1 comprises two sets of string-able elements, such as beads 14 and 16, for stringing together on a length of stringing material 10 to form the bracelet 1 and at least one removable charm 26 for removable placement between beads 14 and/or 16 to note a record.

The stringing material 10 holding the beads 14 and 16 can be any flexible wires 10 known to one skilled in the art. In the preferred embodiment, the wire 10 is a memory wire, which is a hardened steel wire which has a certain coil shape and can be stretched open but springs back to and retains its original shape when released, even after repeated use. Stainless steel Remembrance™ Memory Wire from Beadalon is an example of such memory wire. Memory wire comes in different sizes to accommodate different diameters, such as ring memory wire, bracelet memory wire and necklace memory wire. Other stringing material 10 such as iron memory wire, cadmium coated stainless steel memory wire, stainless steel nylon coated beading wire, Stretch Magic™, hook-to-hook or hook-to-ball bracelet bands, elastic, can also be used.

The first set of beads 14 includes marked beads 14 having sequential numbers thereon. In the preferred embodiment wherein the bracelet 1 is used to note time, the first set of beads 14 includes twelve (12) sequential numbers, as shown in FIG. 1, to represent a twelve-hour clock. However, the number of beads 14 and therefore the number of sequential numbers used on the bracelet 1 may vary, more or less, depending on the intended usage of the bracelet 1. For example, a bracelet 1 intended to count the number of glasses of water drank in a day may include only eight (8) sequential numbers or a bracelet 1 intended to count the number of cycles/laps during an exercise routine may include more than twelve (12) sequential numbers. Although FIG. 1 shows that a two digit number, e.g. 10, 11 and 12, is formed from two beads 14, a single bead 14 bearing the two digit number can also be used (not shown). Further, other markings signifying numbers, such as with a plurality of dots or other designs, can also be used.

The second set of beads 16 includes unmarked beads 16. In the preferred embodiment shown in FIG. 1 wherein the bracelet 1 is used to note time, four unmarked beads 16 are placed between each marked beads 14 such that each unmarked bead 16 represent a fifteen (15) minute interval between the hours of the adjacent marked beads 14. Alternatively, each sequentially numerically marked bead 14 can be separated by more or less unmarked beads 16, such as two, six or twelve unmarked beads 16 such that each unmarked bead 16 represents a thirty (30), ten (10) or five (5) minute interval, respectively.

The sequence of stringing beads 14 and 16 on wire 10 for the preferred embodiment is as follows: a number one bead 14, four unmarked bead 16, a number two bead 14, four unmarked bead 16, a number three bead 14, four unmarked bead 16, . . . a number twelve bead 14. As discussed above, since the number of marked beads 14 can increase or decrease, a plurality of unmarked beads 16 may be placed before and/or after the marked beads 14 to sufficiently cover the length of wire 10 used for a particular user's wrist size.

Beads 14 and 16 may be of any design, size, material, shape, and color to achieve the aesthetic preference of each individual user. Further, each marked bead 14 and each unmarked bead 16 may be of different design, size and color from other marked beads 14 and unmarked beads 16.

The removable charm 26 may be placed between any beads 14 and/or 16. In the preferred embodiment as shown in FIG. 1, charm 26 is placed in the center of the unmarked beads 16 between the two marked beads 14 with the numbers four and five, which notes the time of half past four (4:30). Charm 26 as shown in FIG. 1 may also represent that a user has completed four cycles/laps of an exercise routine. Therefore, the charm 26 can be moved to any location to note the time or count. For example, for the preferred embodiment, placing the charm 26 to the right of a marked number bead 14 marks the hour, placing the charm 26 after the first unmarked bead 16 next to a number bead 14 marks a quarter past the hour, placing the charm 26 after the second unmarked bead 16 next to a number bead 14 marks half past the hour, and placing the charm 26 after the third unmarked bead 16 next to a number bead 14 marks forty-five minutes past the hour.

Figure 2A:
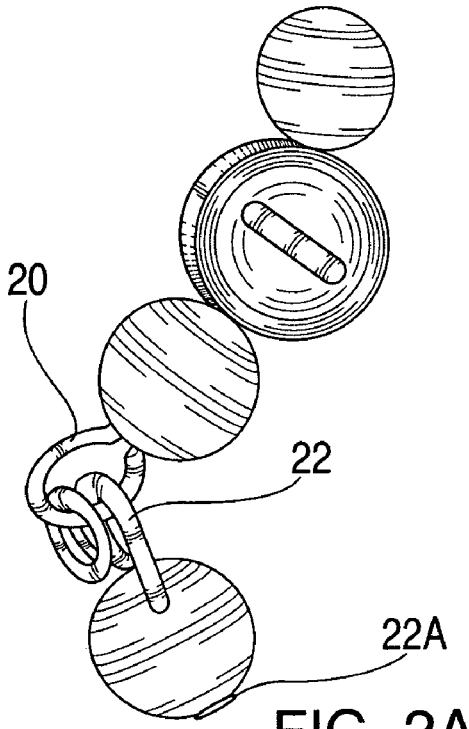
FIGS. 2A and 2B illustrate one end of the bracelet with a decorative pin and bead combination.
Figure 2B:
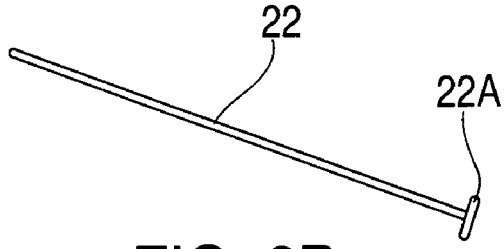

FIG. 2A shows an enlarged view of one end of the bracelet 1. Each end of the wire 10 forms a loop 20 to prevent beads 14 or 16 from being disengaged from the wire 10. As shown in FIGS. 2A and 2B, a pin 22 with an enlarged end 22*a* retains an unmarked bead 16. The pin 22 can be made of a soft metal such as sterling silver, base metal or a composite metal known to one skilled in the art. The opposite end of pin 22 is coiled to engage loop 20. The unmarked bead 16 on the pin 22 provides an added, optional, decorative element to bracelet 1.

Figure 3:
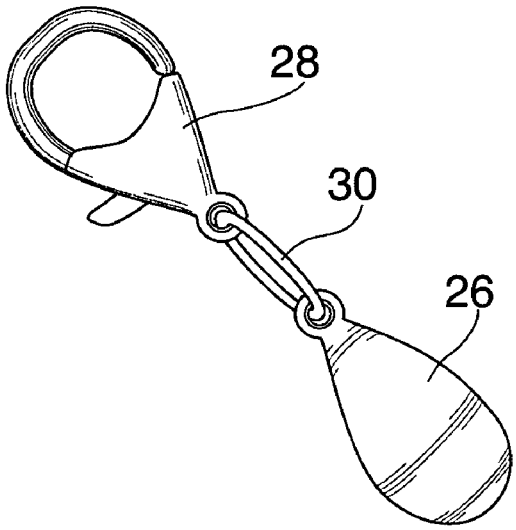
FIG. 3 is a removable charm of the present invention.
Figure 4:
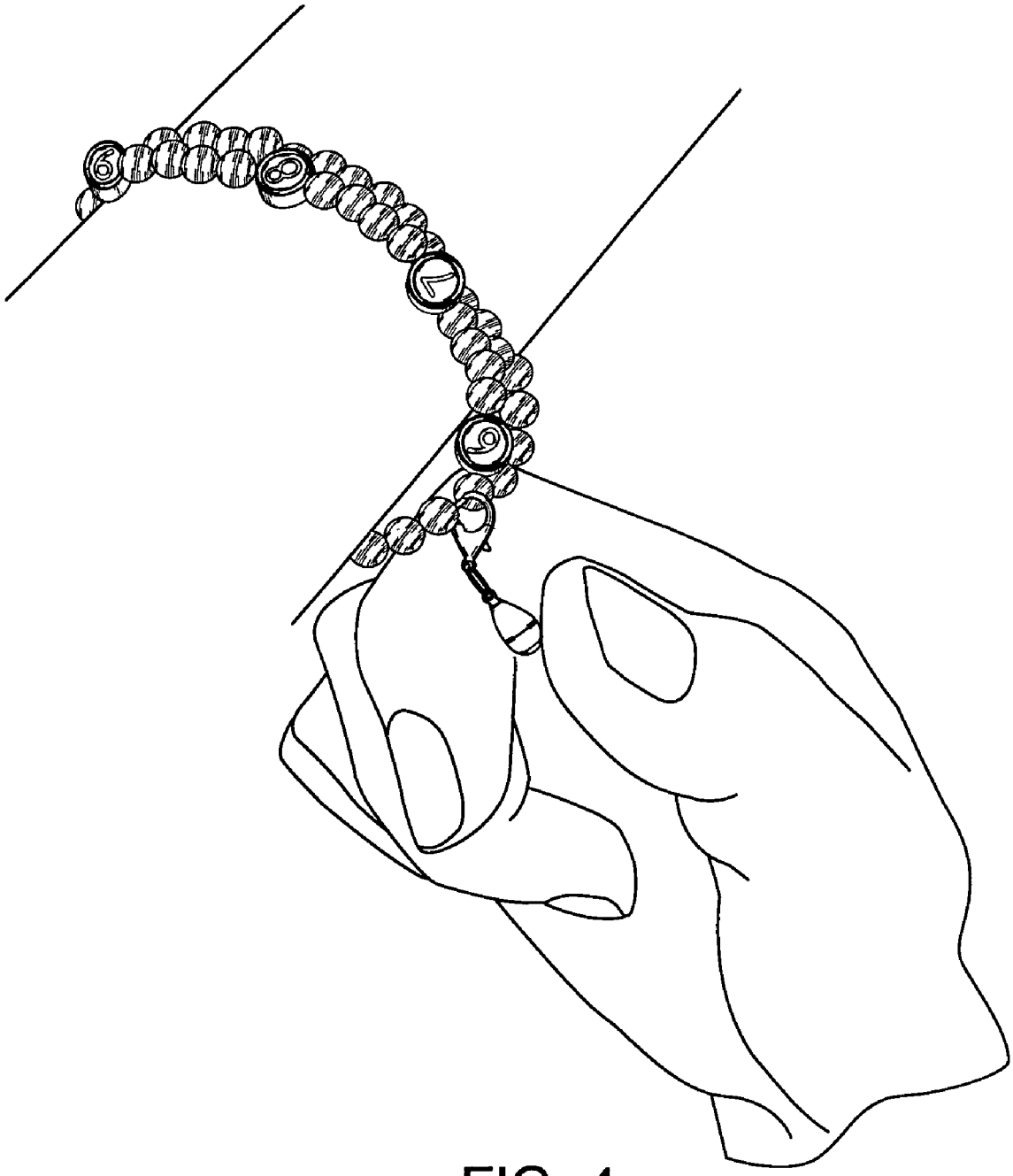
FIG. 4 illustrates a user placing the charm on the bracelet to note the time 6:30.

The removable charm 26 of FIG. 3 comprises a decorative charm element 26 attached to a clasp 28 through an intermediary split ring 30. The split ring 30 may be partially opened such that the charm element 26 and clasp 28 can be hooked together before closing the split ring 30. The clasp 28 can be selectively opened to an open position 32 as shown in FIG. 4 such that the removable charm 26 can be hooked onto any location along the length of bracelet 1. As known to one skilled in the art, the clasp can be made from sterling silver or brass, coated with imitation rhodium or gilt. FIG. 4 shows the removable charm 26 being placed in the center of the unmarked beads 16 between the two marked beads 14 with the numbers six and seven, which notes the time of half past six (6:30).

Charm element 26 is shown to be tear drop shaped. However, charm 26 may be of any design, size, material (e.g. sterling silver, pewter, brass, etc.), shape, and color to achieve the aesthetic preference of each individual user. The charm 26 may also hold pictures.

Figure 5:
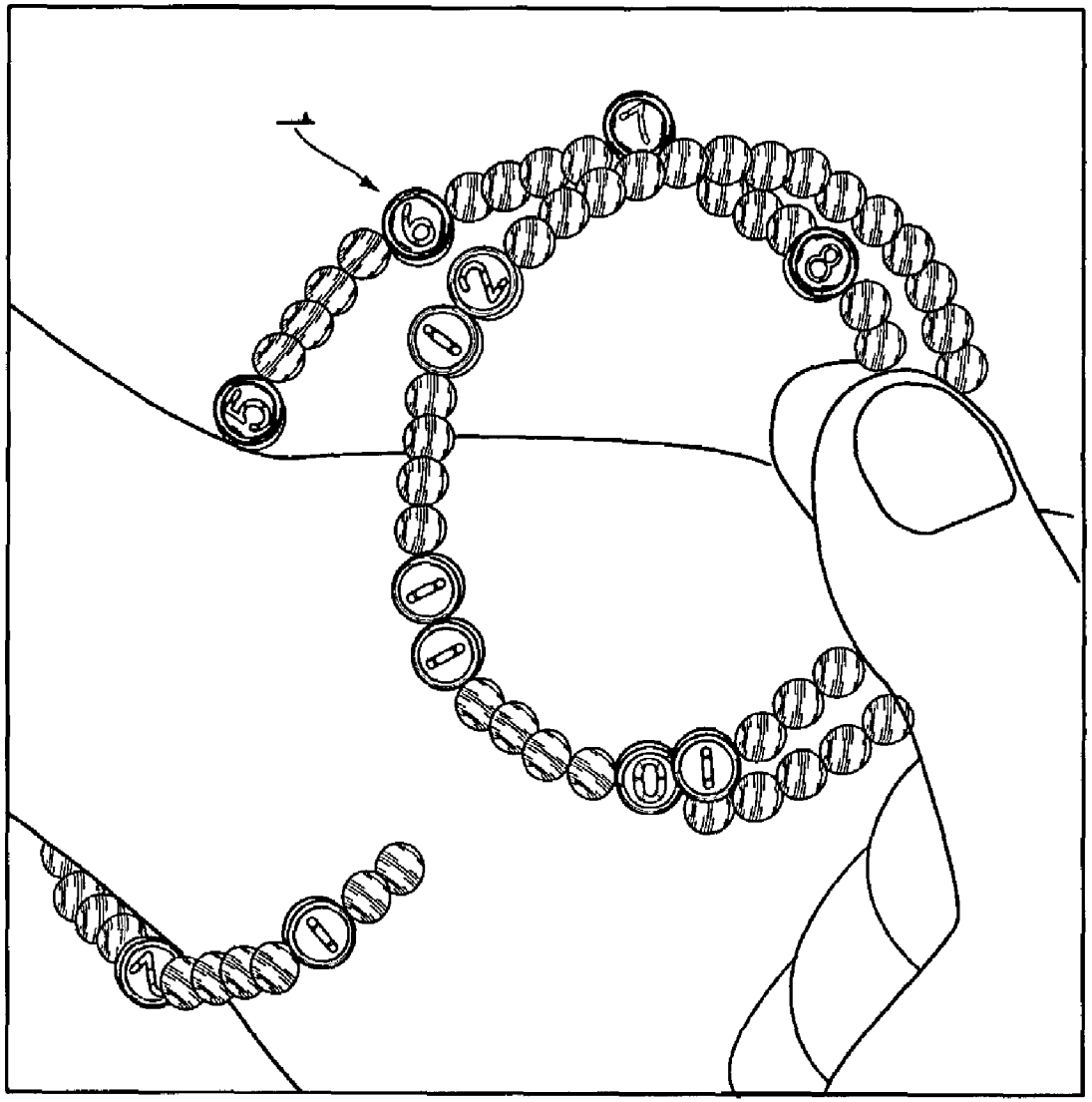
FIG. 5 shows the method of placing the bracelet on a user's wrist.
Figure 6:
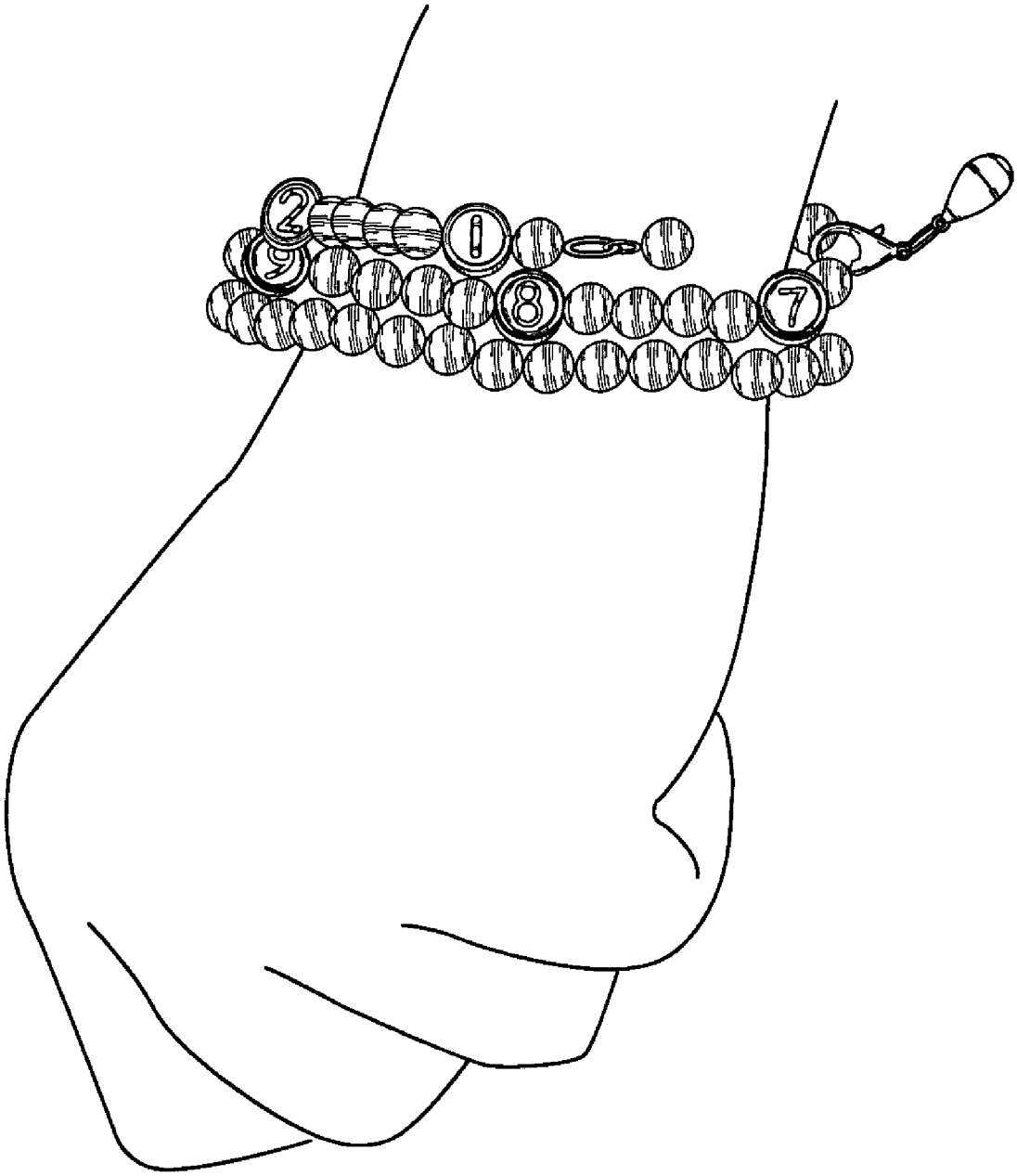
FIG. 6 shows the bracelet as worn by a user.

As shown in FIGS. 5 and 6, the wire 10 of the bracelet 1 has a length sufficient to form more than one loop around a user's wrist. Placement of the bracelet 1 on a user's wrist is achieved by first hooking one end of the bracelet 1 over the wrist while stretching out the remaining length of the bracelet 1 and then winding the remaining length of the bracelet 1 around the wrist, allowing the bracelet 1 to spring back to its original shape to encircle the wrist.

The method of using bracelet 1 of the present invention in the preferred embodiment as shown in FIG. 1 relates to infants' nursing cycle. During the course of a day, after a mother finishes nursing her infant, the removable charm 26 can be placed to mark the time when she last fed the infant. Also, the placement of the bracelet 1 on either left or right wrist may indicate the corresponding breast the infant last fed from. Therefore, a quick look at the bracelet 1 provides the mother with instant information. The charm 26 can also be used to note the time when the infant should be fed next and the placement of the bracelet on either wrist may indicate which corresponding breast the infant should begin his/her next feeding. The charm 26 can also be used to note the number of times the baby has been fed during the course of a day. The different notations marked by charm 26 described above can be used either individually or in combination by using a plurality of charms 26. Therefore, a plurality of charms 26, in different shapes, sizes, colors, etc., can signify different notations. For example, a gold spherical charm 26 may indicate when the baby was last fed, a silver cube charm 26 may indicate when the baby should be fed next and a star black charm 26 may indicate the number of times the infant has been fed.

The bracelet 1 in the preferred embodiment for use to note infants' nursing cycle acts as a teaching tool for new mothers because if her baby cries, with a quick look at the bracelet 1, she can determine whether her baby is crying from hunger based on when the next feeding is due.

Although certain features of the invention have been illustrated and described herein, other better modifications and changes will occur to those skilled in the art. It is, therefore, to be understood that the appended claims are intended to cover all such modification and changes that fall within the spirit of the invention.

What I claim is:

1. A wearable device for record/event tracking with markings that signify different records or events by a user comprising:

a first set of string-able elements comprises twelve beads having sequential numerical markings thereon;

a second set of at least one string-able element without markings thereon;

a length of stringing material adapted to be worn by said user for retaining said first and second sets of string-able elements in a predetermined sequence; and at least one removable record tracking element for removable placement by said user on a predetermined position on said stringing material between any two selected string-able elements to note a record relevant to adjacent markings, said removable record tracking element comprises means for removable attachment to said predetermined position on said stringing material.

2. The device of claim 1 wherein said second set of string-able elements comprises at least one bead.

3. The device of claim 1 wherein said string-able elements from said first set and said string-able elements from said second set are retained by said length of stringing material in an alternate fashion.

4. The device of claim 1 wherein said length of stringing material comprises a length of flexible wire.

5. The device of claim 4 wherein said length of stringing material is sufficiently long to form at least one loop around a wrist of said user of said device.

6. The device of claim 1 wherein said length of stringing material comprises a length of memory wire.

7. The device of claim 1 wherein said second set of string-able elements comprises at least forty-four beads, wherein four beads from said second set are retained between each pair of beads from said first set.

8. The device of claim 1 wherein said sequential numerical markings includes the numbers one through twelve.

9. The device of claim 1 wherein said length of stringing material having opposite ends, wherein a loop is formed on each end to retain said first and second sets of string-able elements.

10. The device of claim 1 wherein said removable record tracking element comprises a charm element and a clasp attached to said charm element that selectively opens or closes for securely placing said record tracking element on said predetermined position of said length of stringing material.

11. A bracelet for a user's wrist for recordlevent tracking with markings that signify different records or events comprising:

a first set of twelve string-able elements, each having a sequential numerical marking of one through twelve thereon;

a second set of at least forty-four string-able elements without numerical markings thereon;

a length of stringing material of sufficient length to wrap around said user's wrist, said length of stringing material alternately retaining said first and second sets of string-able elements such that each string-able element from said first set is followed by four string-able elements from said second set; and at least one removable charm for removable placement on a predetermined position on said length of stringing material between any two selected string-able elements to note a record relevant to adjacent markings, said removable record tracking element comprises means for removable attachment to said predetermined position on said stringing material.

12. The A method of record/event tracking with markings that signify different records or events comprising the steps of:

providing a length of stringing material;

providing a first set of string-able elements comprises twelve beads having sequential numerical markings thereon.

providing a second set of at least one string-able element without markings thereon;

stringing said first and second sets of string-able elements in a predetermined sequence on said length of stringing material;

providing at least one removable charm; and marking a record relevant to adjacent markings by placing said charm at a predetermined position on said stringing material between any two selected string-able elements.

13. The method of claim 12 wherein said second set of string-able elements comprises at least one bead.

14. The method of claim 12 wherein said string-able elements from said first set and said string-able elements from said second set are retained by said length of stringing material in an alternate fashion.

15. The method of claim 12 wherein said length of stringing material comprises a length of flexible wire.

16. The method of claim 12 wherein said length of stringing material is sufficiently long to form at least one loop around a wrist of a user of said device.

17. The method of claim 12 wherein said length of stringing material comprises a length of memory wire.

18. The method of claim 12 wherein said second set of string-able elements comprises at least forty-four beads, wherein four beads from said second set are retained between each pair of beads from said first set.

19. The method of claim 12 wherein said sequential numerical markings includes the numbers one through twelve.

20. The method of claim 12 wherein said length of stringing material having opposite ends, wherein a loop is formed on each end to retain said first and second sets of string-able elements.

21. The method of claim 12 wherein said removable charm comprises a charm element and a clasp attached to said charm element that selectively opens or closes for securely placing said charm on said length of stringing material.

22. A method of record/event tracking with markings that signify different records or events comprising the steps of:

providing a length of stringing material;

providing a first set of twelve string-able elements, each having a sequential numerical marking of one through twelve thereon;

providing a second set of at least forty-four string-able elements without numerical markings thereon;

stringing on said length of stringing material said first and second sets of string-able elements alternately such that each string-able element from said first set is followed by four string-able elements from said second set;

providing at least one removable charm; and marking a record relevant to adjacent numerical markings by placing said charm at a predetermined position on said stringing material between any two selected string-able elements.

23. A method of record/event tracking with markings that signify different records or events comprising the steps of:

providing a bracelet for a user's wrist;

providing a length of stringing material of sufficient length to wrap around said user's wrist to form said bracelet;

providing a first set of at least one string-able element having numerical markings thereon;

providing a second set of at least one string-able element without numerical markings thereon;

stringing said first and second sets of string-able elements on said length of stringing material in a predetermined seciuence to form said bracelet;

providing at least one removable charm;

marking a record relevant to adjacent numerical markings by placing said charm at a predetermined position on said stringing material between any two selected string-able elements; and marking a second record by removing said bracelet from a user's wrist to the user's other wrist.

* * * * *